United States Patent [19]

Bates

[11] Patent Number: 5,033,687

[45] Date of Patent: Jul. 23, 1991

[54] CABLE DRUM HANDLING APPARATUS

[75] Inventor: Andrew Bates, Farnsfield, United Kingdom

[73] Assignee: Autoreel Limited, Nottingham, England

[21] Appl. No.: 381,782

[22] Filed: Jul. 18, 1989

[51] Int. Cl.[5] ..... B65H 75/00; B65H 54/553

[52] U.S. Cl. ..... 242/54 R; 242/129.510

[58] Field of Search ..... 242/54 R, 58.6, 79, 242/68.4, 129.51; 464/113, 114, 117

[56] References Cited

U.S. PATENT DOCUMENTS

| | | | |
|---|---|---|---|
| 2,651,479 | 9/1953 | Bauer | 242/129.51 |
| 2,948,559 | 8/1958 | Recker | 464/113 |
| 2,991,953 | 7/1961 | Moser et al. | 242/58.6 |
| 3,687,385 | 8/1972 | Skalleberg | 242/54 R |
| 4,368,859 | 1/1983 | Focke et al. | 242/129.51 X |
| 4,558,830 | 12/1985 | Larsson | 242/54 R |
| 4,693,433 | 9/1987 | Martin | 242/58.6 |
| 4,706,905 | 11/1987 | Torres | 242/58.6 X |
| 4,718,817 | 1/1988 | Maillefer | 242/79 X |

FOREIGN PATENT DOCUMENTS

| | | | |
|---|---|---|---|
| 7505445 | 11/1976 | Netherlands | 242/58.6 |
| 1489176 | 10/1977 | United Kingdom . | |

OTHER PUBLICATIONS

Auto Reel Cable Winding Systems (2 pages), (Known to Applicant as Commercially Available), Prior to 7/89.

Reel-O-TeCL, Belford PTR Reeler (2 pages) (Known to Applicant as Commercially Available), Prior to 7/89.

Reel Holder Coiler Truck Art CMS-50 (1 page) (Known to Applicant as Commercially Available), Prior to 7/89.

*Primary Examiner*—Daniel P. Stodola
*Assistant Examiner*—John P. Darling
*Attorney, Agent, or Firm*—Lorusso & Loud

[57] ABSTRACT

Cable drum handling apparatus comprises opposed drum supports each comprising a parallel linkage in which parallel links are pivoted on a subframe and on support means for a pintle. Pintles are mounted coaxially on each support means. A motor rotates worms which engage extensions of the link to move the pintles towards and away from one another to move them into and out of supporting engagement with a drum between the supports. A motor on one of the supports can rotate the drum. The sub-frame is pivoted about an axis A on a main frame which can be readily moved. An air cylinder can pivot the subframe about the axis A to raise and lower the drum. The apparatus is simple and relatively inexpensive.

11 Claims, 3 Drawing Sheets

CABLE DRUM HANDLING APPARATUS

FIELD OF THE INVENTION

This invention relates to cable drum handling apparatus and especially cable winding apparatus.

In some circumstances it is necessary to wind cable from a supply onto a drum, for example when supplying relatively small lengths of cable for use. It is desirable, to handle various lengths and diameter of cable, that such cable winding apparatus is capable of accommodating drums of various different widths and diameters.

Machines have been proposed for mounting cable drums for this purpose. However, apparatus previously proposed has not been altogether satisfactory in that it has been complex and/or relatively expensive. For example one apparatus proposed for this purpose has been constructed so that in order to adjust it to accommodate drums of various widths, the apparatus has been constructed in two parts movable towards and away from one another, the parts being relatively massive and cumbersome to move requiring heavy duty motors and the like; in another apparatus proposed for this purpose, pintles have been carried at the ends of arms mounted on a linear slide for movement towards and away from one another—whilst such apparatus is much less cumbersome than the other prior art apparatus referred to, the linear slide must be manufactured with considerable accuracy over a relatively wide distance. Both of the prior apparatuses referred to above have been relatively complex in construction requiring a large number of parts in order to provide for the appropriate adjustment. Both of these apparatuses have, therefore, been relative expensive to manufacture.

OBJECT OF THE INVENTION

One of the objects of the present invention is to provide an improved cable drum handling apparatus.

SUMMARY OF THE INVENTION

In one aspect, the invention may be considered to provide cable drum handling apparatus comprising frame means, a pair of opposed drum supports each comprising a parallel linkage, each linkage having two parallel links pivoted on said frame means, support means for a pintle and a pintle mounted coaxially on each support means, the said parallel links being also pivoted on the support means remote from said frame means, and apparatus further comprising means for moving the parallel linkages to move the pintles towards and away from one another, whilst the pintles remain coaxial whereby to move them into and out of supporting engagement with a drum positioned between the drum supports.

In a preferred apparatus embodying the invention, the means for moving the parallel linkages in arranged to effect movement of the support means towards and away from one another by equidistant amounts: this acts to ensure that a drum supported by the drum supports is centered in the apparatus.

Preferably in a machine in accordance with the invention, the means for moving the parallel links comprises rotary drive means adapted to engage the two parallel linkages and effect the movement and conveniently, a single motor is positioned to rotate rotary drive means; suitably the drive means comprises a pair of worms having threads of opposite hand, the motor being positioned between the two worms.

Preferably universal joints are positioned between the motor and the parallel linkages to permit any necessary adjustment in alignment of the drive means, especially as the parallel linkages are moved.

In a preferred apparatus in accordance with the invention, the means for moving the parallel linkages is arranged, for each linkage, to engage a projecting arm of one of the two parallel links at the side relative to the position at which it is pivoted on the frame means opposite the support means for the pintle.

In preferred apparatus in accordance with the invention, the frame means is mounted on a main frame of the apparatus for movement to raise and lower a drum engaged by the opposed drum supports; conveniently, for this purpose, the frame means is pivoted on the main frame for movement about an axis parallel to the axis of the pintles. A preferred apparatus comprises means for effecting raising or lowering of the frame means. Preferably the means for effecting raising or lowering of the frame means comprises a piston and cylinder arrangement.

A preferred apparatus in accordance with the invention comprises wheels on which the main frame is mounted so that the apparatus can readily be moved to transport a drum supported by it to and from an appropriate location for receiving or dispensing cable onto or from the drum.

There now follows a detailed description to be read with reference to the accompanying drawings of cable drum handling apparatus, namely cable winding apparatus, embodying the invention. It will be realised that this apparatus has been selected for description to illustrate the invention by way of example, and not of limitation of the invention.

DESCRIPTION OF THE PREFERRED EMBODIMENT

Figure 1:
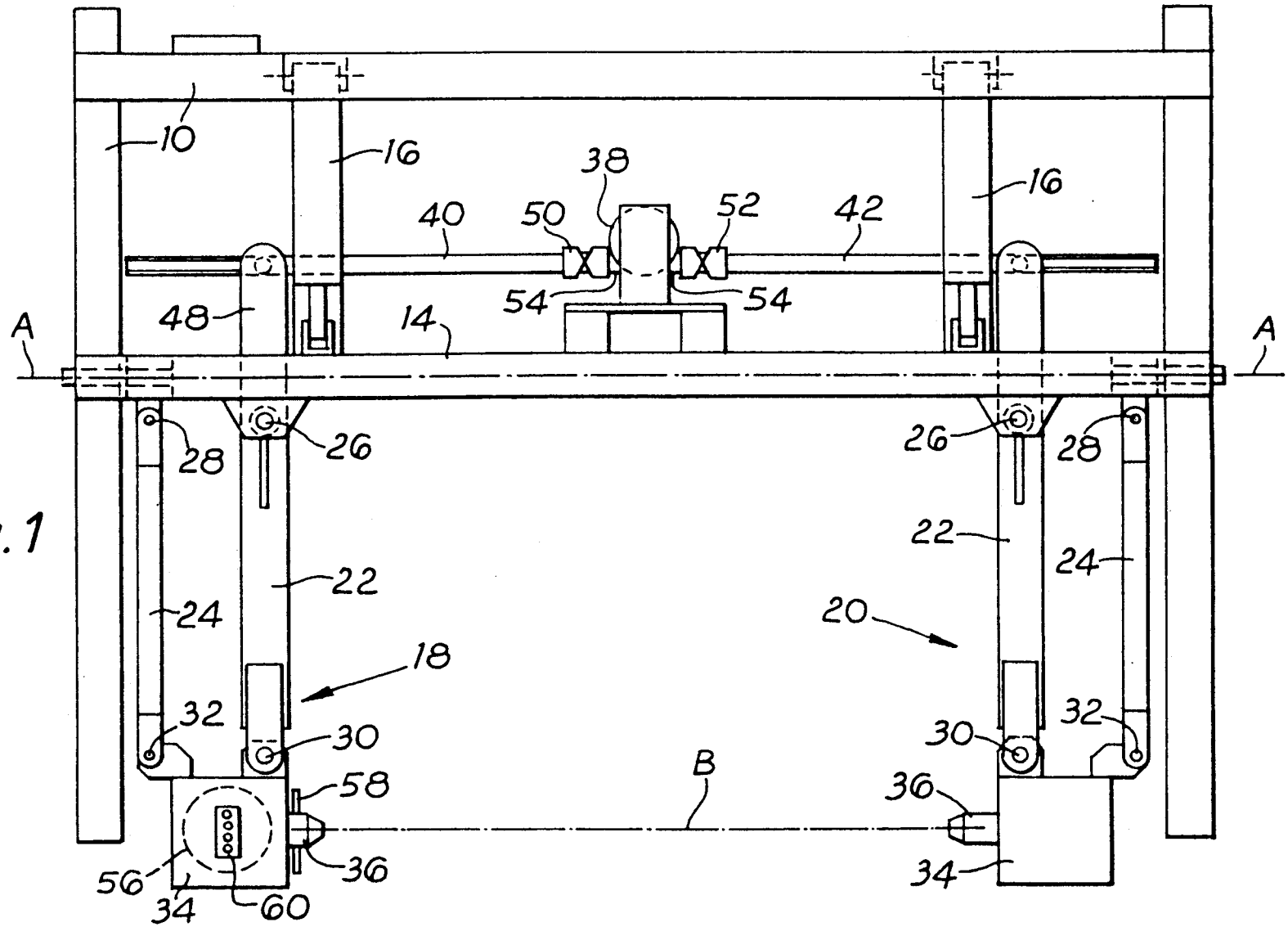
FIG. 1 is a plan view of cable winding apparatus embodying the invention.
Figure 2:
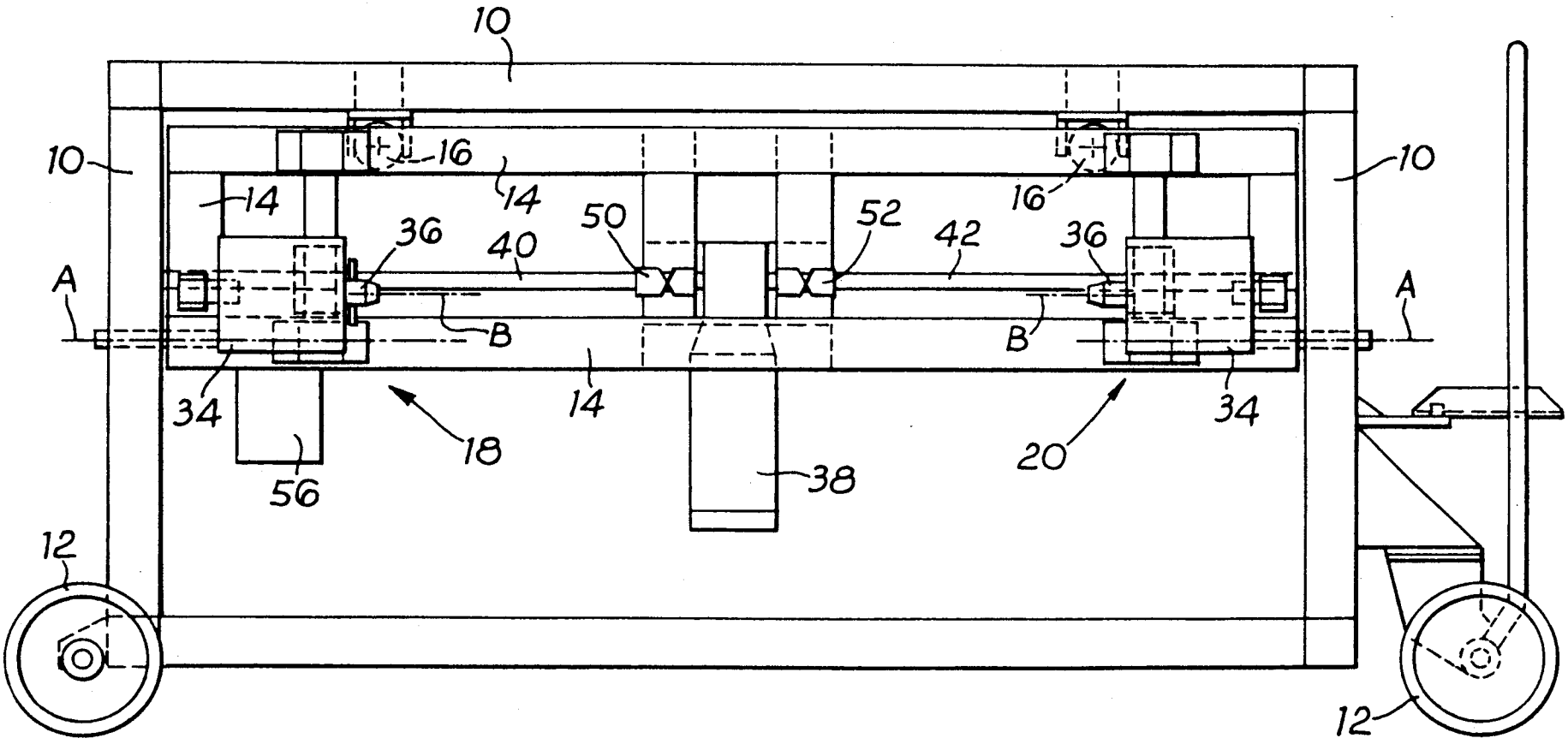
FIG. 2 is a front view of the apparatus shown in FIG. 1.
Figure 3:
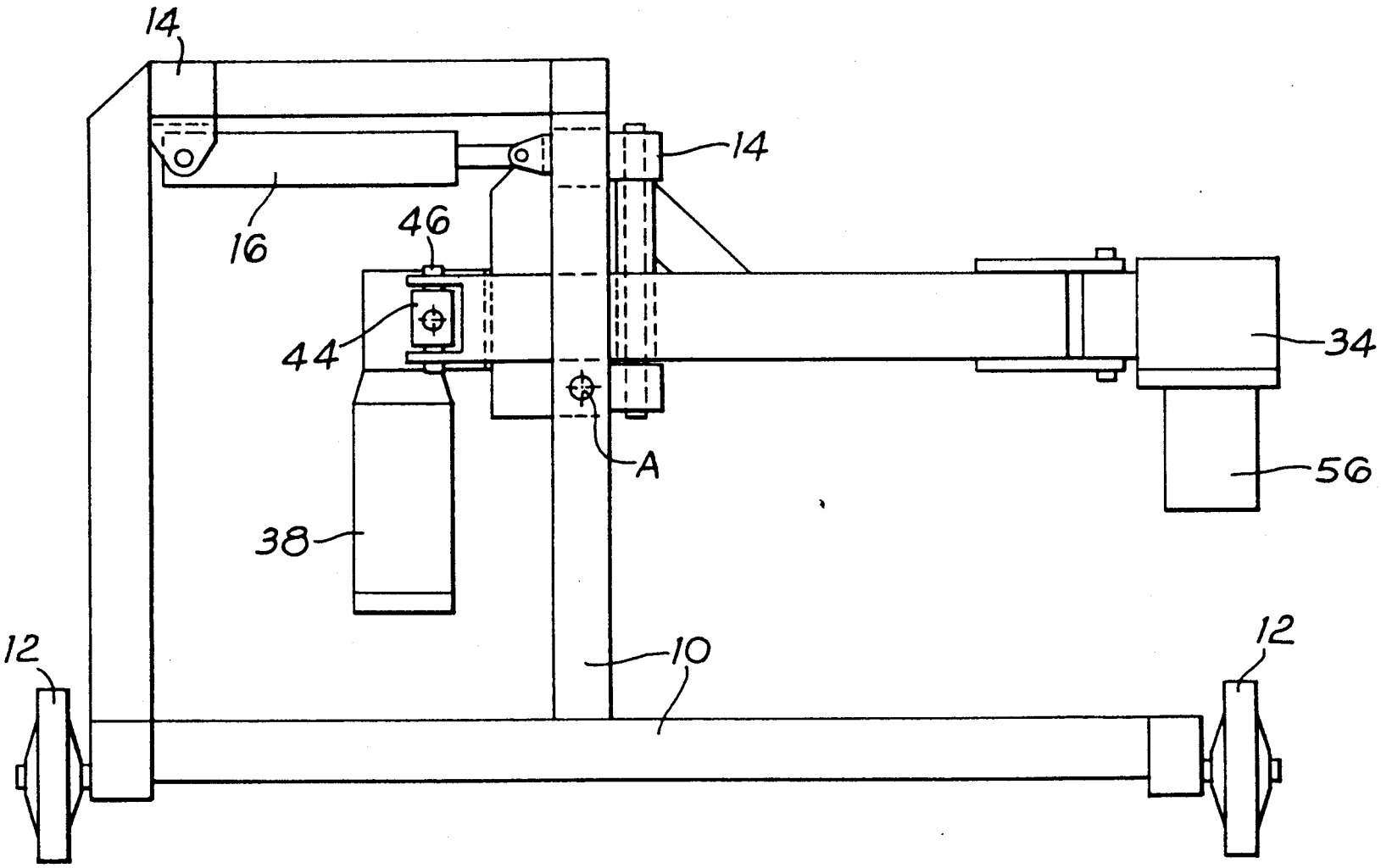
FIG. 3 is a side view of the apparatus shown in FIG. 1.

The illustrative cable winding apparatus comprises a main frame 10 supported on wheels 12 so that the apparatus can readily be moved to a desired operating position.

Frame means comprising a subframe 14 is mounted for pivotal movement about an axis A on the main frame 10. A piston and cylinder arrangement 16 extends between a member of the main frame 10 and a member of the subframe 14 thus to effect pivotal movement of the subframe 14 about the axis A.

A pair of opposed drum supports 18, 20 are mounted on the subframe 14. As can be seen from the accompanying drawings, the drum supports 18, 20 are substantially mirror images of one another and thus only the drum support 18 will be described in detail, for convenience.

The parallel linkage of the first drum support 18 comprises two parallel links 22, 24 pivotally mounted on parallel pivots 26, 28 respectively, carried by the subframe 14. Remote from the subframe 14 the links 22, 24 are connected by parallel pivots 30, 32 respectively to support means 34 for a pintle 36: as can be seen by viewing FIG. 1, the parallel links 22, 24, subframe 14 and support 34 supply a parallel linkage or pantagraph assembly.

The two opposed drum supports 18, 20 are constructed and mounted so that the pintles 36 mounted on the support means are coaxial; the construction and arrangement of the illustrative apparatus is such that they remain coaxial as the parallel linkages of the supports 18, 20 are moved. Thus the pintles are adapted to engage coaxial openings at opposite ends of a cable drum whereby to support the drum for rotation about an axis B of the pintles 36. The axis B of the pintles 36 is parallel with the axis A about which the subframe is pivoted.

The illustrative apparatus further comprises means for moving the parallel linkages of the supports 18, 20 whereby to move the pintles 36 towards and away from one another. The means for moving the parallel linkages comprises an electric motor 38 mounted on the subframe 14 and arranged to operate drive means comprising worms 40, 42 having threads of opposite hands arranged to be threadedly engaged in nuts 44 mounted on pivots 46 parallel with the pivots 26, 28, and a rearwad extension 48 of the link 22 which projects beyond the pivot 26 opposite the support means 34.

The worms 40, 42 are connected by universal joints 50, 52 to an output shaft 54 of the motor 38.

A drum rotating 56 is mounted on one of the support means 34 and is drivingly connected with a connector 58 adapted to engage a drum carried by the pintles 36 whereby to rotate the connetor and thus a drum carried by the pintles 36.

A control panel 60 is mounted on the support means 34 of the support 18 and provides controls, operable by the operator, to operate the piston and cylinder arrangement 16 to raise and lower the supports and the motor 38 to move the support means 34 inwardly or outwardly.

In the use of the illustrative apparatus, the apparatus may be wheeled to an appropriate position to pick up a cable drum. This may be on an appropriate rack or at floor level and the subframe is pivoted by the piston and cylinder arrangement 16 about the axis A to raise or lower the support means 34 of the drum supports 18, 20 to align the pintles 36 with the central support opening in the appropriate drum. When the pintles are aligned with the opening in the centre of the drum, the drum being positioned between the drum supports 18, 20, the motor 38 is actuated by an operator to cause the parallel linkages of the supports 18, 20 to be moved to move the support means 34 inwardly towards one another. The construction and arrangement is such that the pintles 36 remain coaxial as they are moved inwardly. As the pintles engage in the central opening in the drum the inward movement of the support means 34 is terminated by the operator; alternatively, sensing means may be provided to sense when the pintles 36 are firmly engaged in the drum. It is not necessary for a drum to be positioned precisely centrally between the supports 18, 20 before, it is picked up because the supports, by their movement, will effect a centering of the drum as they engage it.

The piston and cylinder arrangement 16 may again be operated to pivot the subframe 14 to position the drum in a suitable position and the illustrative apparatus may be wheeled to an appropriated position by the operator, for example to receive a length of cable from a racked supply of cable. The cable is preferably fed onto the drum carried by the drum supports 18, 20 through a suitable known meansuring device (not shown) which may preferably be mounted on the subframe 14 of the illustrative apparatus. To wind the appropriate length of cable on the drum, the drum rotating motor 56 is actuated by the operator to rotate the drum through the connector 58. When the measuring device has measured a preselected length of cable, the motor 56 is stopped and the cable severed; the motor 56 may then be restarted to wind the severed end of cable onto the drum.

Whereas the illustrative apparatus is a cable winding apparatus and comprises the winding motor 56, apparatus in accordance with the invention may be used for paying out cable from a drum, in which case a braking system (not shown) may be provided to prevent the drum rotating uncontrollably when cable is being unwound from the drum. A suitable braking system to be operated by the user of the apparatus can readily be devised by one skilled in the art.

The illustrative apparatus is of simple and robust construction and does not require extremely high precision in its manufacture (in comparison, for example, with the precision slide referred to in the prior art apparatus). The illustrative apparatus is therefore relatively inexpensive and is reliable in operation.

I claim:

1. Cable drum handling apparatus comprising a frame, a pair of opposed drum supports each comprising a parallel linkage, each linkage having two parallel links pivoted on said frame, means for supporting a pintle and a pintle mounted coaxially on each means for supporting a pintle, said parallel links being also pivoted on the means for supporting a pintle remote from said frame, and means for moving the parallel linkages to move the pintles toward and away from one another while the pintles remain coaxial to move them into and out of supporting engagement with a drum positioned between the drum supports, said parallel linkages and means for moving said parallel linkages providing means to facilitate the movement of the pintles toward one another while the pintles remain coaxial so that drums of various sized may be accommodated.

2. Cable drum handling apparatus according to claim 1 wherein the means for moving the parallel linkages is arranged to effect movement of the means for supporting a pintle towards and away from each other by equidistant amounts.

3. Cable drum handling apparatus according to claim 1 wherein the means for moving the parallel links comprises a single motor.

4. Cable drum handling apparatus according to claim 3 comprising universal joints positioned between the motor and the parallel linkages.

5. Cable drum handling apparatus according to claim 1 wherein the means for moving the parallel links comprises rotary drive means adapted to engage the two parallel linkages and effect the movement and a single motor is positioned to rotate said rotary drive means.

6. Cable drum handling apparatus according to claim 1 wherein the means for moving the parallel links comprises rotary drive means adapted to engage the two parallel linkages and effect the movement and a single motor is positioned to rotate said rotary drive means, wherein the drive means comprises a pair of worms having threads of opposite hand, the motor being positioned between the two worms.

7. Cable drum handling apparatus according to claim 1 wherein one of the parallel links of each linkage comprises an extension, the means for moving the linkages being arranged to engage the extension to effect movement.

8. Cable drum handling apparatus according to claim 1 comprising a motor which can be actuated by an operator to rotate a drum carried by the drum supports.

9. Cable drum handling apparatus according to claim 1 comprising a main frame on which the frame is mounted for movement to raise and lower a drum engaged by the drum supports.

10. Cable drum handling apparatus according to claim 9 comprising means for effecting raising or lowering of the frame.

11. Cable drum handling apparatus according to claim 1 comprising a main frame on which the frame is mounted for movement to raise and lower a drum engaged by the drum supports wherein the frame is pivoted on the main frame for movement about an axis parallel to the axis of the pintles.

* * * * *